US008705322B2

(12) United States Patent
Sawada

(10) Patent No.: US 8,705,322 B2
(45) **Date of Patent: *Apr. 22, 2014**

(54) TIMEPIECE DEVICE WITH MULTIPLE-HAND

(75) Inventor: Makoto Sawada, Nishitokyo (JP)

(73) Assignee: Casio Computer Co., Ltd, Tokyo (JP)

( * ) Notice: Subject to any disclaimer, the term of this patent is extended or adjusted under 35 U.S.C. 154(b) by 315 days.

This patent is subject to a terminal disclaimer.

(21) Appl. No.: 13/164,842

(22) Filed: Jun. 21, 2011

(65) Prior Publication Data

US 2011/0317525 A1 Dec. 29, 2011

(30) Foreign Application Priority Data

Jun. 24, 2010 (JP) ..... 2010-143323

(51) Int. Cl.
*G04C 9/00* (2006.01)

(52) U.S. Cl.
USPC ..... 368/80; 368/185; 368/220

(58) Field of Classification Search
USPC ..... 368/80–81, 76, 220, 185, 187
See application file for complete search history.

(56) References Cited

U.S. PATENT DOCUMENTS

| | | | | |
|---|---|---|---|---|
| 5,999,495 | A * | 12/1999 | Hashizume et al. | 368/80 |
| 2004/0085860 | A1* | 5/2004 | Yiu | 368/185 |
| 2006/0114750 | A1* | 6/2006 | Iida et al. | 368/67 |

FOREIGN PATENT DOCUMENTS

| | | |
|---|---|---|
| JP | 60-189886 | 12/1985 |
| JP | 2-83487 | 6/1990 |
| JP | 2007-121075 | 5/2007 |
| WO | 03/054637 A1 | 7/2003 |

OTHER PUBLICATIONS

Office Action for Japanese Patent Application No. 2010-143323 dated Sep. 4, 2012.
Office Action for Japanese Patent Application No. 2010-143323 dated May 22, 2012.
Japanese Office Action for Japanese Application No. 2010-143319 mailed on May 29, 2012.
Office Action dated Jul. 8, 2013 for U.S. Appl. No. 13/164,841, 21 pages.

* cited by examiner

*Primary Examiner* — Sean Kayes
(74) *Attorney, Agent, or Firm* — Amin, Turocy & Watson, LLP

(57) ABSTRACT

A timepiece device with multiple-hand which can be miniaturized and made thin as a whole has a configuration where a hour hand hour wheel positioned close to an hour hand to which a rotation movement of a 3rd motor via an hour hand gear train mechanism and a functional hand hour wheel positioned close to a functional hand to which a rotation movement of a 4th motor via a functional hand gear train mechanism are arranged on a front side of a support plate, and a 4th wheel positioned close to a second hand and a 2nd wheel positioned close to a minute hand are arranged on a rear side of the support plate.

2 Claims, 20 Drawing Sheets

TIMEPIECE DEVICE WITH MULTIPLE-HAND

CROSS-REFERENCE TO RELATED APPLICATIONS

This application is based upon and claims the benefit of priority from the prior Japanese Patent Application No. 2010-143323 filed on 24 Jun. 2010, the entire contents of which are incorporated herein by reference.

BACKGROUND OF THE INVENTION

1. Field of the Invention

The present invention relates to a timepiece device with multiple-hand and, more generally, a multi-hand electronic device.

2. Description of Related Art

There has conventionally been widely used a multi-hand electronic device with a plurality of hands, such as analogue timepiece (watch/clock) with a second hand, a minute hand, and an hour hand. With regard to the multi-hand electronic device, there has been known a technique described in Japanese Patent Application Laid-Open Publication No. 2007-121075 to planarly arrange a plurality of sets of gear trains for driving a plurality of hands in order to thin an entire timepiece.

However, there has been a need for the electronic device, especially for a small electronic device such as a wrist timepiece, to implement various functions while being as compact as possible. Hence, in order to achieve multiple hands and complication of the electronic device as well as miniaturization of the entire device, it has been required to further miniaturize and make thin the entire device.

In this regard, in the multi-hand electronic device, gears for driving hands occupy most of space, and therefore, if the gears can be efficiently mounted, the entire device can be further miniaturized and made thin.

SUMMARY OF THE INVENTION

The prevent invention is made in view of the above circumstances, and an object of the present invention is to provide a multi-hand electronic device which can be miniaturized and made thin as a whole.

In order to solve abovementioned problem, there is provided a timepiece device with multiple-hand including: a plurality of hands; one or more driving motors for making the hands rotate; a gear train mechanism which includes a plurality of gears for transmitting a rotation movement of one of the driving motors to at least one of the hands; and a support plate which supports the gears; wherein the hands include a 1st hand and a 2nd hand to which the rotation movement of the driving motors is transmitted via the gear train mechanism; and wherein one of the gears positioned close to the 1st hand is arranged on one side of the support plate, and one of the other gears positioned close to the 2nd hand is arranged on the other side of the support plate.

According to the present invention, among the hands to which the rotation movement of the driving motors is transmitted via the gear train mechanism, the gear positioned close to the 1st hand is arranged on the front side of the support plate and the gear positioned close to the 2nd hand is arranged on the rear side of the support plate, and thereby the gears are provided in a distributed arrangement in the vicinity of the 1st and 2nd hands (for example, near the center of the multi-hand electronic device) without being concentrated on a single surface of the support plate. By this configuration, the gears can be efficiently assembled in the limited space, and thereby it becomes possible to miniaturize and thin the entire multi-hand electronic device.

BRIEF DESCRIPTION OF THE DRAWINGS

The present invention will sufficiently be understood by the following detailed description and accompanying drawing, but they are provided for illustration only, and not for limiting the scope of the invention.

DETAILED DESCRIPTION OF THE PREFERRED EMBODIMENTS

Hereinafter, preferable embodiments of the present invention will be described with reference to the drawings.

A case will be described below where a multi-hand electronic device of the present invention is an analogue timepiece (hereinafter "pointer indication type timepiece") which has a plurality of hands including a second hand, minute hand, hour hand and functional hand, and which displays the time and the like by electrically driving and rotating these hands, but embodiments to which the present invention is applicable are not limited to this.

An embodiment of the pointer indication type timepiece as the multi-hand electronic device of the present invention will be described first referring to FIGS. 1 to 14.

Figure 1:
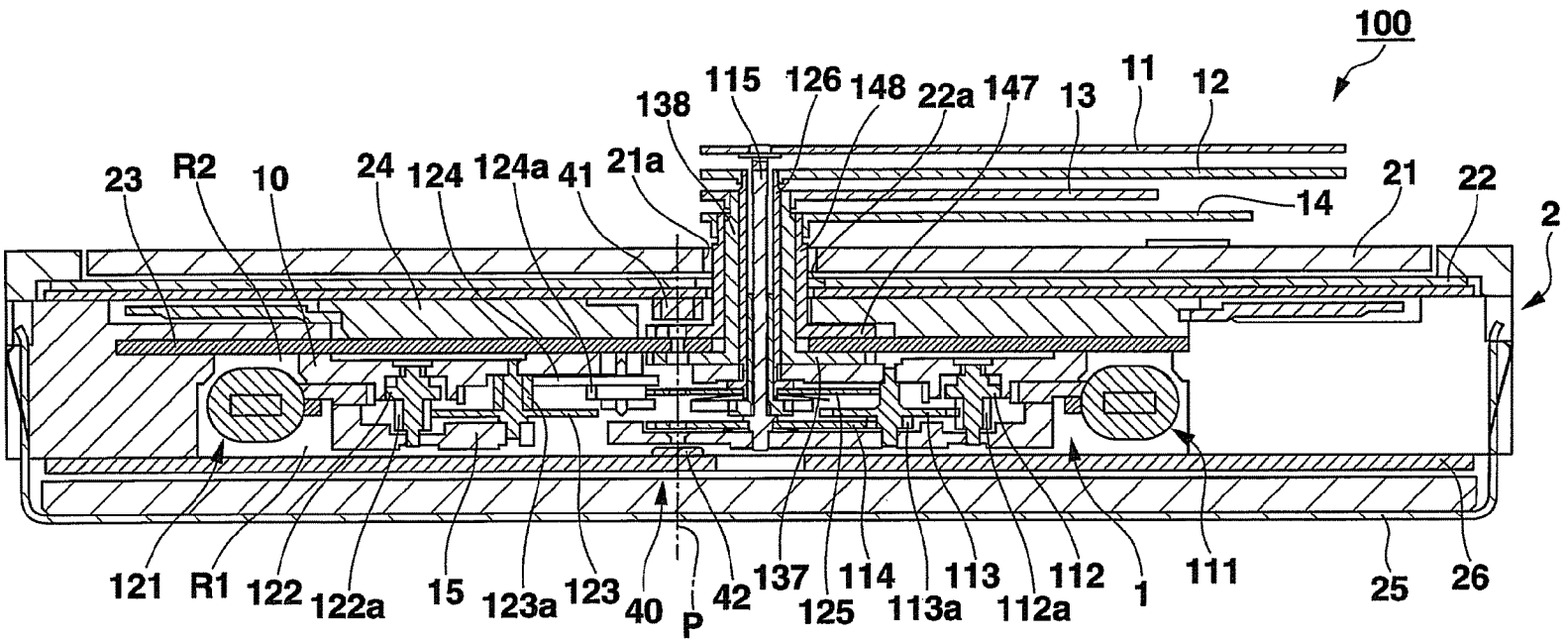
FIG. 1 is a main-part sectional view showing a schematic configuration of a second hand gear train mechanism and a minute hand gear train of a pointer indication type timepiece according to an embodiment.
Figure 2:
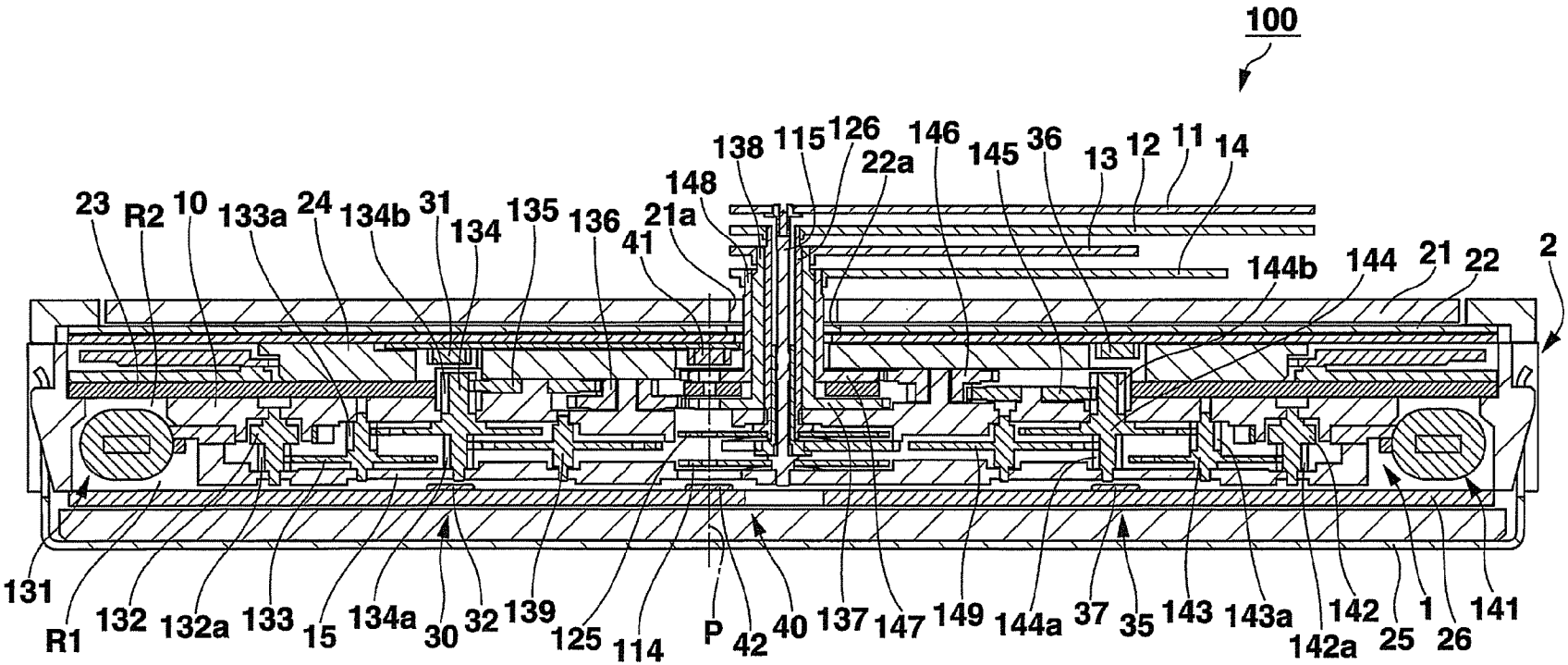
FIG. 2 is a main-part sectional view showing a schematic configuration of an hour hand gear train mechanism and a functional hand gear train of a pointer indication type timepiece according to the embodiment.

FIGS. 1 and 2 are sectional side views respectively obtained by cutting the pointer indication type timepiece of the embodiment at different portions.

As showed in FIGS. 1 and 2, the pointer indication type timepiece 100 of the embodiment has a timepiece movement 1 which has a plurality of hands and a mechanism for moving these hands, and a housing 2 which houses the timepiece movement 1 made of resin or the like.

On a front surface side (visible side: upside in FIGS. 1 and 2) of the housing 2, a substantially circular dial 21 formed in a thin plate shape is arranged. On the rear surface side (downside in FIGS. 1 and 2) of the dial 21, a solar panel 22 is arranged.

Penetrating holes 21*a* and 22*a* are provided in approximately centers of the dial 21 and solar panel 22 respectively, and shaft members (i.e. a second hand shaft 115, a minute hand shaft 126, an hour hand cylindrical member 138, and a functional hand cylindrical member 148) which support the hands (i.e. a second hand 11, minute hand 12, hour hand 13, and functional hand 14) of the timepiece movement 1 are projected from the inside to the outside (upside in FIGS. 1 and 2) of the housing 2 through the penetrating holes 21*a* and 22*a*.

Further, on the rear surface side (downside in FIGS. 1 and 2) of the housing 2, a holding member 25 which holds the timepiece movement 1 housed in the housing 2 is attached.

Inside the housing 2 and on the front surface side (upside in FIGS. 1 and 2) of the holding member 25, a circuit substrate 26 is provided. On the circuit substrate 26, now-shown various electronic parts are mounted.

Inside the housing 2 and on the front surface side (upside in FIGS. 1 and 2) of the timepiece movement 1, there is provided a magnetic shield plate 23 which has a magnetic shield function of preventing the magnetic field from coming in aftermentioned 1st to 4th motors 111, 121, 131 and 141 (see FIG. 3) from the outside.

Figure 3:
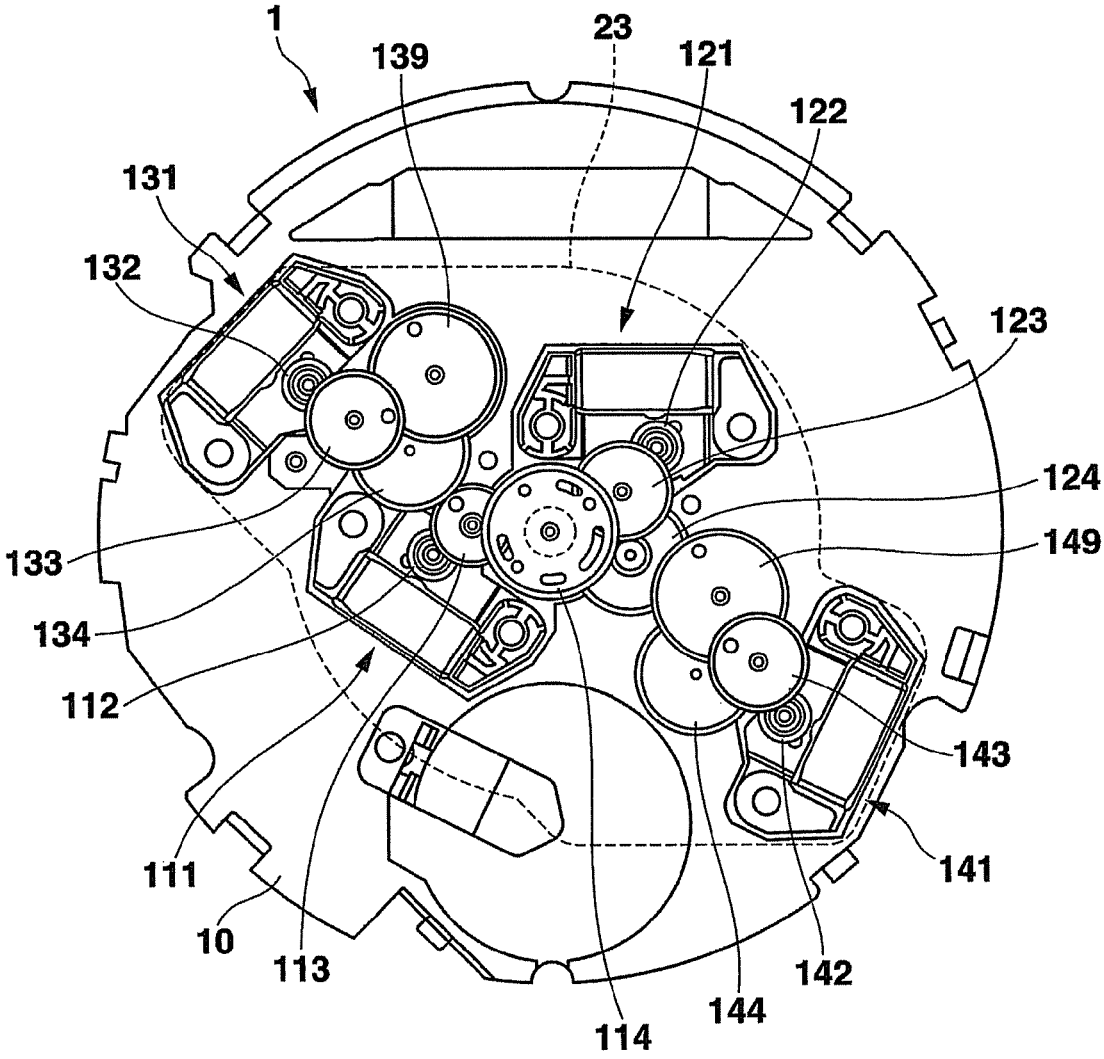
FIG. 3 is a plan view showing a timepiece movement of the pointer indication type timepiece shown in FIG. 1 viewed from a rear surface side thereof.

As showed by the broken line in FIG. 3, the magnetic shield plate 23 is arranged to cover the 1st to 4th motors 111, 121, 131 and 141. The shape of the magnetic shield plate 23 is not limited to the showed shape as long as the 1st to 4th motors 111, 121, 131 and 141 are substantially covered.

The magnetic shield plate 23 is made of material having high relative magnetic permeability, such as iron whose property is similar to pure iron, and permalloy. The material to make the magnetic shield plate 23 is not limited to this, and another material having high relative magnetic permeability (for example, 300 or more relative magnetic permeability) is applicable.

Thus, since the magnetic shield plate 23 formed from material having high relatively magnetic permeability is arranged, it is possible to attract the magnetic field coming from the outside to the magnetic shield plate 23 to prevent the magnetic field from affecting the 1st to 4th motors 111, 121, 131 and 141.

Between the magnetic shield plate 23 and solar panel 22, a date indicator holding plate 24 is arranged.

Figure 4:
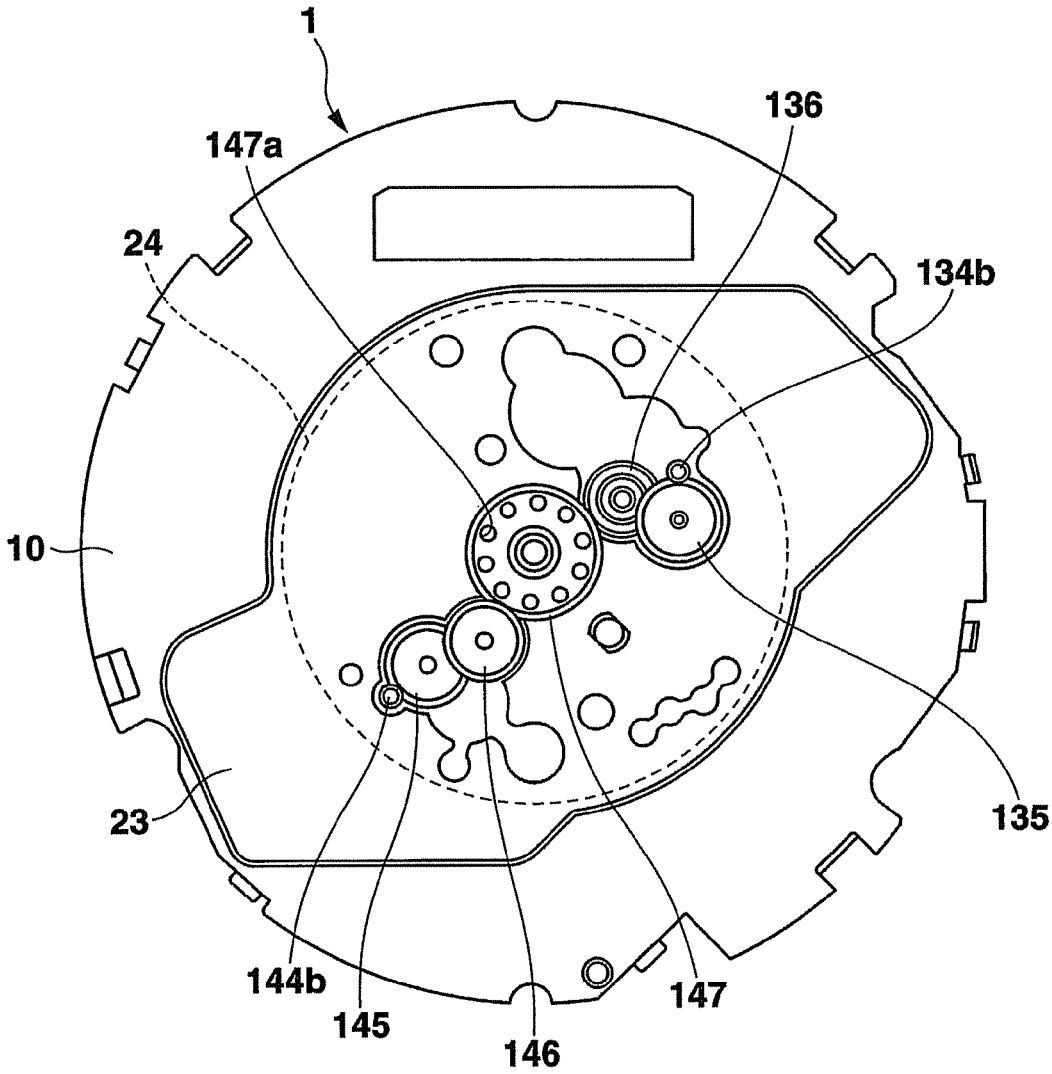
FIG. 4 is a plan view showing a timepiece movement of a pointer indication type timepiece shown in FIG. 1 viewed from a front surface side thereof.

FIG. 3 is a plan view showing the timepiece movement 1 viewed from a rear surface side (downside in FIGS. 1 and 2) thereof, and FIG. 4 is a plan view showing the timepiece movement 1 from the visible side (dial placement side, or upside in FIGS. 1 and 2) thereof.

As showed in FIGS. 1 to 4, the timepiece movement 1 is equipped with a gear support plate 10 which is a support plate for supporting a plurality of gears.

The gear support plate 10 partitions the inside of the pointer indication type timepiece 100 into a 1st space R1 and a 2nd space R2. For example, the rear surface side (downside in FIGS. 1 and 2) of the gear support plate 10 is the 1st space R1 and the front surface side (upside in FIGS. 1 and 2) of the gear support plate 10 is the 2nd space R2. The gear support plate 10 is made of resin for example, but the material to make the gear support plate 10 is not limited in particular.

Further, on the rear surface side (downside in FIGS. 1 and 2) of the timepiece movement 1, there is provided a gear train receiver plate 15 which supports the gears by sandwiching the gears between the gear support plate 10 and the gear train receiver plate 15. FIG. 3 shows the state where the gear train receiver plate 15 is detached.

A configuration of gear train mechanisms provided in the timepiece movement 1 of the embodiment will be described referring to FIGS. 1 to 4.

As showed in FIGS. 1 and 2, the timepiece movement 1 of the embodiment has four hands of the second hand 11, minute hand 12, hour hand 13 and functional hand 14.

Further, as showed in FIG. 4, the timepiece movement 1 has four driving motors of a 1st motor 111 for driving the second hand 11, a 2nd motor 121 for driving the minute hand 12, the 3rd motor 131 for driving the hour hand 13, and a 4th motor 141 for driving the functional hand 14, and is configured to independently drive the second hand 11, minute hand 12, hour hand 13 and functional hand 14 by the 1st to 4th motors 111, 121, 131 and 141, respectively.

The 1st to 4th motors 111, 121, 131 and 141 are stepping motors each having a bipolar stator and bipolar rotor, for example.

Further, the timepiece movement 1 is provided with the gear train mechanisms which transmit rotation movements of the 1st to 4th motors 111, 121, 131 and 141 to the second hand 11, minute hand 12, hour hand 13 and functional hand 14, respectively.

A second hand gear train mechanism which transmits a rotation movement of the 1st motor 111 to the second hand 11 has a 5th wheel 113 which meshes with a gear member 112*a* of a rotor 112 provided in the 1st motor 111 to transmit a rotation of the 5th gear 113 thereto, and a 4th wheel 114 which meshes with a gear member 113*a* of the 5th wheel 113 and rotates.

This 4th wheel 114 is attached to the second hand shaft 115 as the shaft member which supports the second hand 11, and the second hand 11 is driven to rotate when the 4th wheel 114 rotates about this second hand shaft 115.

Similarly, a minute hand gear train mechanism which transmits a rotation movement of the 2nd motor 121 to the minute hand 12 has an intermediate wheel 123 which meshes with a gear member 122*a* of a rotor 122 provided in the 2nd motor 121 to transmits a rotation of the intermediate wheel 123 thereto, a 3rd wheel 124 which meshes with a gear member 123*a* of the intermediate wheel 123 and rotates, and a 2nd wheel 125 which meshes with a gear member 124*a* of the 3rd wheel 124 and rotates.

The 2nd wheel 125 is attached to the minute hand shaft 126 as the shaft member which supports the minute hand 12, and the minute hand 12 is driven to rotate when the 2nd wheel 125 rotates about this minute hand shaft 126.

Further, an hour hand gear train mechanism which transmits a rotation movement of the 3rd motor 131 to the hour hand 13 has a 1st intermediate wheel 133 which meshes with a gear member 132*a* of a rotor 132 provided in the 3rd motor 131 to transmit a rotation of the 1st intermediate wheel 133 thereto, a 2nd intermediate wheel 134 which meshes with a gear member 133*a* of the 1st intermediate wheel 133 and rotates, a 3rd intermediate wheel 135 which meshes with a gear member 134*a* of the 2nd intermediate wheel 134 and rotates, a 4th intermediate wheel 136 which meshes with a gear member 135*a* of the 3rd intermediate wheel 135, and an hour hand hour wheel 137 which meshes with the 4th intermediate wheel 136 and rotates.

Figure 5:
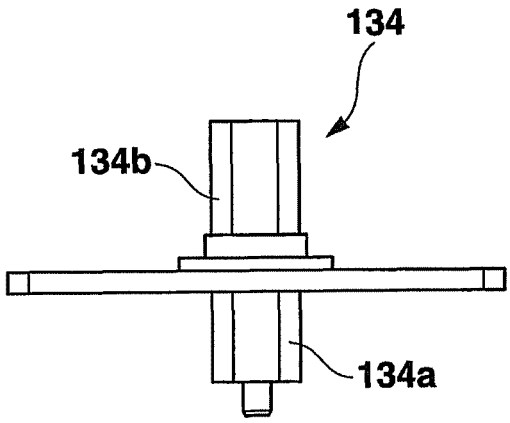
FIG. 5 is a side view showing a 2nd intermediate wheel provided in a pointer indication type timepiece according to the embodiment.
Figure 6:
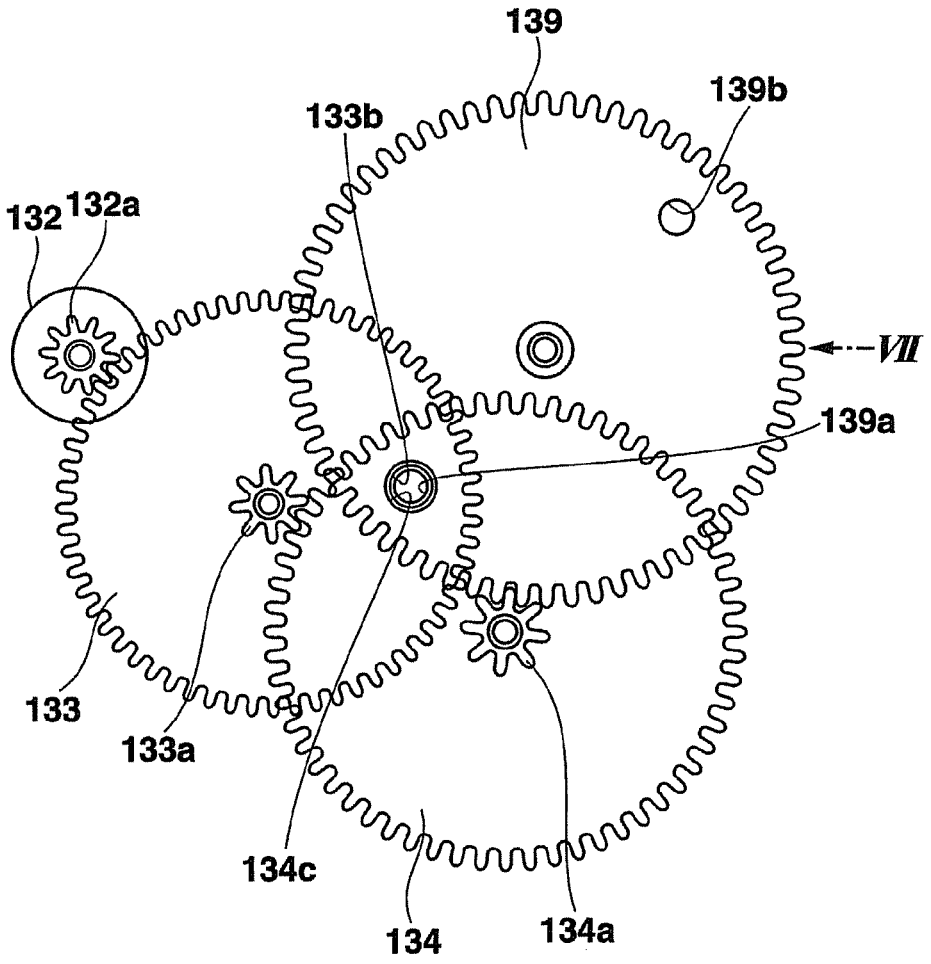
FIG. 6 is a plan view showing a positional relationship between a 1st intermediate wheel, the 2nd intermediate wheel, and a hand position detecting wheel.

FIG. 5 is a side view showing a configuration of the 2nd intermediate wheel 134 of the embodiment, and FIG. 6 is a plan view showing the 2nd intermediate wheel 134 and a gear connected thereto viewed from a rear surface side. Further, FIG. 7 is a main-part sectional view of FIG. 6 seen from a direction of Arrow VII.

As showed in FIG. 5, the 2nd intermediate wheel 134 of the embodiment is a 1st gear on the front and rear surfaces of which pinion gears as the gear members are provided, and the pinion gears meshes with different gears on the front and rear surfaces of the gear support plate 10 to drive these gears at the same time.

Figure 7:
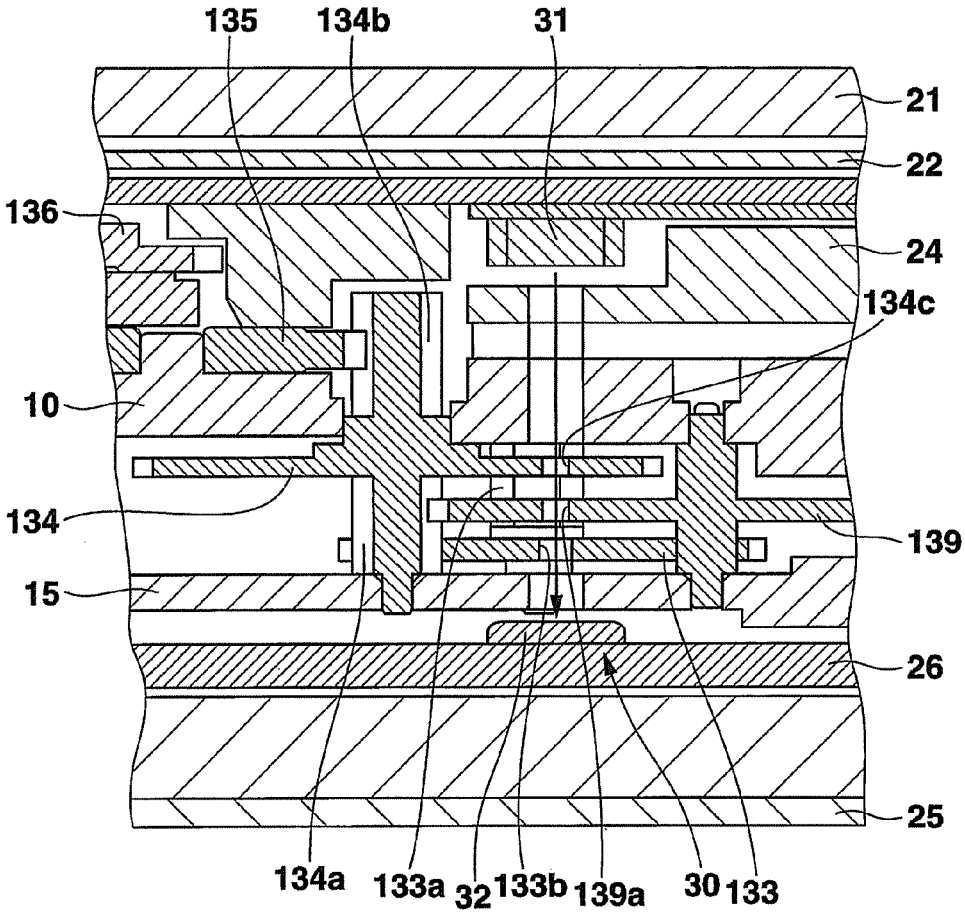
FIG. 7 is a sectional view of FIG. 6 seen from a direction of Arrow VII.

More specifically, as showed in FIGS. 6 and 7, on the rear surface side (downside in FIGS. 1 and 2) of the gear support plate 10, namely in a portion positioned inside the 1st space R1 of the pointer indication type timepiece 100, a 1st small gear 134*a* is provided. Further, as showed in FIG. 7, on the front surface side (upside in FIGS. 1 and 2) of the gear support plate 10, namely in the portion positioned in the 2nd space R2 of the pointer indication type timepiece 100, a 2nd small gear 134*b* is provided.

In the embodiment, the 2nd intermediate wheel 134 meshes with the 1st intermediate wheel 133 as the 2nd gear in the 1st space R1 which is a space on the rear surface side of the gear support plate 10 in the pointer indication type timepiece 100, and the 1st intermediate wheel 133 transmits a rotation movement of the 3rd motor 131 to this 2nd intermediate wheel 134.

Further, the 2nd small gear 134*b* of the 2nd intermediate wheel 134 provided on the front surface side of the gear support plate 10 meshes with the 3rd intermediate wheel 135 as the 3rd gear in the 2nd space R2 which is a space on the front surface side of the gear support plate 10 in the pointer indication type timepiece 100, and drives the 3rd intermediate wheel 135 to rotate.

Since the 3rd intermediate wheel 135 is configured to mesh with the 2nd small gear 134*b* provided on the front surface side of the gear support plate 10, the hour hand gear train mechanism up to the 2nd intermediate wheel 134 is arranged on the rear surface side of the gear support plate 10 (namely the inside of the 1st space R1) and the hour hand gear train mechanism of the 3rd intermediate wheel 135 and the wheels subsequent thereto is arranged on the front surface side of the gear support plate 10 (namely the inside of the 2nd space R2). Thus, the side of the gear support plate 10 on which the wheels of the hour hand gear train mechanism are arranged is changed from the rear surface side to the front surface side along the way.

Further, the 1st small gear 134*a* of the 2nd intermediate wheel 134 provided on the rear surface side (downside in FIGS. 1 and 2) of the gear support plate 10 meshes with a hand position detecting wheel 139 forming a 1st hand position detecting mechanism 30 which will be described below, and rotates/moves the hand position detecting wheel 139 with a rotation of the 2nd intermediate wheel 134.

In addition, the sizes and numbers of the 1st small gears 134*a* and 2nd small gears 133*b* provided on the front and rear surfaces of the 2nd intermediate gear 134 are not limited in particular, and various small gears can be provided depending on the intended use.

In the center of the hour hand hour wheel 137, the cylindrical member 138 as the shaft member which is formed to be a hollow tube is provided to stand, and the hour hand 13 is attached to the front end of the cylindrical member 138. The minute hand shaft 126 penetrates through the cylindrical member 138, and the second hand shaft 115 penetrates through the minute hand shaft 126.

Similarly, a functional hand gear train mechanism which transmits a rotation movement of the 4th motor 141 to the functional hand 14 has a 1st intermediate wheel 143 which meshes with a rotor 142 provided in the 4th motor 141 to transmit a rotation of the rotor 143, a 2nd intermediate wheel 144 which meshes with a gear member 143*a* of the 1st intermediate wheel 143 to rotate, a 3rd intermediate wheel 145 which meshes with a gear member 144*a* of the 2nd intermediate wheel 144 to rotate, a 4th intermediate wheel 146 which meshes with the 3rd intermediate wheel 145 to rotate, and a functional hand hour wheel 147 which meshes with the 4th intermediate wheel 146 to rotate.

Similar to the 2nd intermediate wheel 134, a 1st small gear 144*a* and 2nd small gear 144*b* are provided on the front and rear surface of the 2nd intermediate wheel 144.

In the embodiment, the 2nd intermediate wheel 144 meshes with the 1st intermediate wheel 143 as the 2nd gear in the 1st space R1 which is the space on the rear surface side of the gear support plate 10 in the pointer indication type timepiece 100, and thereby the 1st intermediate wheel 143 transmits a rotation movement of the 3rd motor 141 to this 2nd intermediate wheel 144.

Further, the 2nd small gear 144*b* of the 2nd intermediate wheel 144 provided on the front surface side of the gear support plate 10 meshes with the 3rd intermediate wheel 145 of the 3rd gear in the 2nd space R2 which is the space on the front surface side of the gear support plate 10 in the pointer indication type timepiece 100, and drives the 3rd intermediate wheel 145 to rotate.

Since the 3rd intermediate wheel 145 is configured to mesh with the 2nd small gear 144*b* provided on the front surface side of the gear support plate 10, the functional hand gear train mechanism up to the 2nd intermediate wheel 144 is arranged on the rear surface side of the gear support plate 10 (namely in the 1st space R1) and the functional hand gear train mechanism subsequent of the 3rd intermediate wheel 145 and the wheels subsequent thereto is arranged on the rear surface side of the gear support plate 10 (namely in the 2nd space R2). Thus, the side of the gear support plate 10 on which the wheels of the functional hand gear train mechanism are arranged is changed from the rear surface side to the front surface side along the way.

Further, the 1st small gear 144*a* of the 2nd intermediate gear 144 provided on the rear surface side (downside in FIGS. 1 and 2) of the gear support plate 10 meshes with the hand position detecting wheel 149 forming the 1st hand position detecting mechanism 35 which will be described below, and rotates/moves the hand position detecting wheel 149 with a rotation of the 2nd intermediate wheel 144.

In addition, the sizes and numbers of the 1st small gears 144*a* and 2nd small gears 144*b* provided on the front and rear surfaces of the 2nd intermediate gear 144 are not limited in particular, and various small gears can be provided depending on the intended use and this is the same as the case of the hour hand gear train mechanism.

In the center of the functional hand hour wheel 147, the cylindrical member 148 which is formed to be a hollow tube is provided to stand, and the functional hand 14 is attached to the front end of the cylindrical member 148.

The cylindrical member 138 of the hour hand hour wheel 137 penetrates through the cylindrical member 148, and the cylindrical member 148 to which the functional hand is attached, the cylindrical member 138 of the hour hand hour wheel 137 to which the hour hand 13 is attached, and the minute hand shaft 126 and second hand shaft 115 which penetrates through the cylindrical member 138 can rotate about the single rotation axis.

In the embodiment, the functional hand hour wheel 147 having the cylindrical member 148 is supported by the magnetic shield plate 23, and the magnetic shield plate 23 functions as a shaft member support plate which supports at least one of the shaft members of the gears provided in the timepiece movement 1.

In the embodiment, the second hand gear train mechanism and the minute hand gear train mechanism among the gear train mechanisms are positioned inside the 1st space R1 below the gear support plate 10. The gears of the 3rd intermediate wheel 135 and the wheels subsequent thereto including the hour hand cylindrical member 138 which is the gear immediately close to the hour hand 13 among the gears forming the functional hand gear train mechanism, and the gears of the 3rd intermediate wheel 145 and the wheels subsequent thereto including the functional hand hour wheel 148 which is the gear immediately close to the functional hand 14 among the gears forming the hour hand gear train mechanism, are positioned in the 2nd space R2 above the gear support plate 10. Consequently, it is possible to prevent the gears from concentrating and overlapping on the upside or downside of the gear support plate 10 in the vicinity of the center of the timepiece movement 1 (namely in the vicinity of the shaft member of the functional hand hour wheel 148 and the like), and efficiently provide the gears in a distributed arrangement.

As showed in FIGS. 6 and 7, in the vicinity of the 2nd intermediate wheel 134, the 1st hand position detecting mechanism 30 which detects the hand position of the pointer indication type timepiece 100 by an optical method is provided. The 1st hand position detecting mechanism 30 has a light emitting element 31 which emits light and a light receiving element 32 which receives light from the light emitting element 31. The light emitting element 31 is composed of LED (Light Emitting Diode) for example, and the light receiving element 32 is composed of a phototransistor. In addition, the compositions of the light emitting element 31 and light receiving element 32 are not limited to those.

Similarly, as showed in FIG. 2, a 1st hand position detecting mechanism 35 which has the light emitting element 36 and light receiving element 37 is also provided on the functional hand gear train mechanism side.

Here, the configuration of the 1st hand position detecting mechanism 30 equipped with the hand position detecting wheel 138 will be described referring to FIGS. 6 to 10. In addition, the 1st hand position detecting mechanism 30 provided on the hour hand train mechanism side and the 1st hand position detecting mechanism 35 provided on the functional hand train mechanism side substantially employ the same configuration, and therefore the 1st hand position detecting mechanism 30 provided on the hour hand train mechanism side will be described with FIGS. 6 to 10 and description of the 1st hand position detecting mechanism 35 provided on the functional hand train mechanism will not be repeated.

The light emitting element 31 is provided on a lower surface of the magnetic shield plate 23 and in a portion where the 1st intermediate wheel 133, 2nd intermediate wheel 134, and hand position detecting wheel 139 overlap from the plan view, for example.

By contrast with this, the light receiving element 32 is provided on the circuit substrate 26 and in a portion where the 1st intermediate wheel 133, 2nd intermediate wheel 134, and hand position detecting wheel 139 overlap from the plan view. The light receiving element 32 is opposed to the light emitting element 31 across the 1st intermediate wheel 133, 2nd intermediate wheel 134, and hand position detecting wheel 139.

In the embodiment, since the 1st hand position detecting mechanism 30 also detects the hand position in addition to a 2nd hand position detecting mechanism 40 which will be described below, it becomes possible to increase precision to detect the hand position.

Figure 8A:
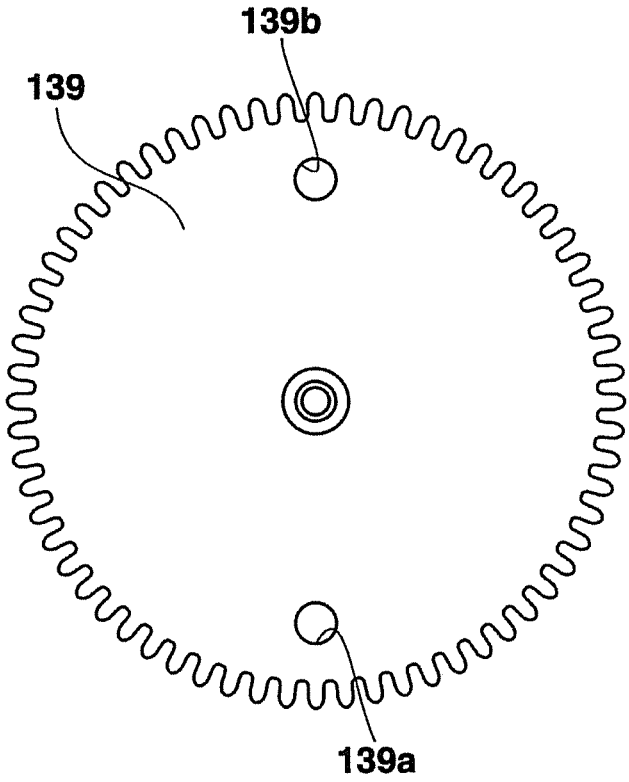
FIG. 8A is a plan view of the hand position detecting wheel.
Figure 8B:
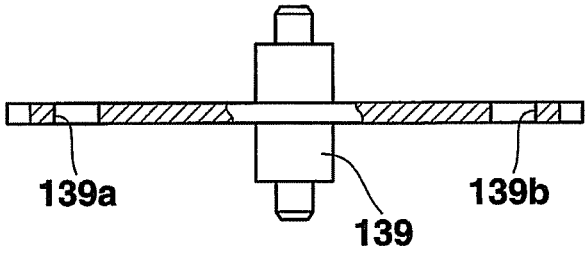
FIG. 8B is a sectional side view of the hand position detecting wheel.

FIG. 8A is a plan view of the hand position detecting wheel 139 of the embodiment, and FIG. 8B is a sectional side view of the hand position detecting wheel 139. In the embodiment, as showed in FIGS. 8A and 8B, a 1st light transmission hole 139*a* and a 2nd light transmission hole 139*b* which are for detecting the hand position are provided in substantially symmetrical positions on a rotational trajectory corresponding to the light detection positions on an optical axis connecting the light emitting element 31 and light receiving element 32.

Figure 9A:
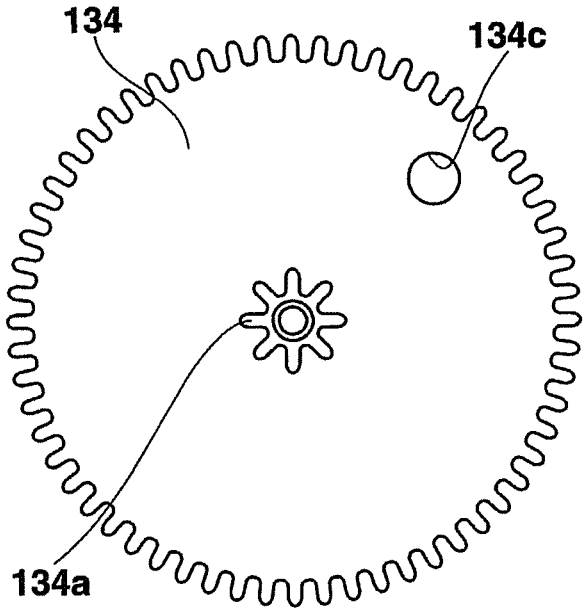
FIG. 9A is a plan view of the 2nd intermediate wheel.
Figure 9B:
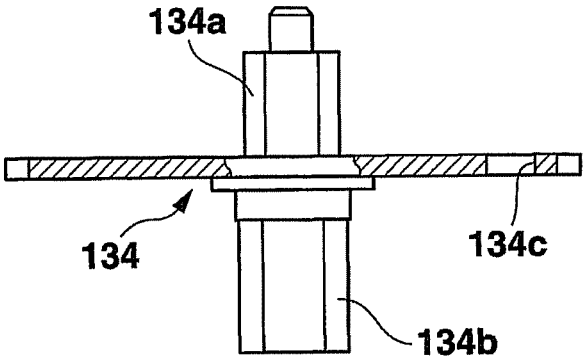
FIG. 9B is a sectional side view of the 2nd intermediate wheel.

FIG. 9A is a plan view of the 2nd intermediate wheel 134 of the embodiment, and FIG. 9B is a sectional side view of the 2nd intermediate wheel 134. In the embodiment, as showed in FIGS. 9A and 9B, one 3rd light transmission hole 134*c* as a detecting hole for detecting the hand position is provided in the 2nd intermediate wheel 134.

Figure 10A:
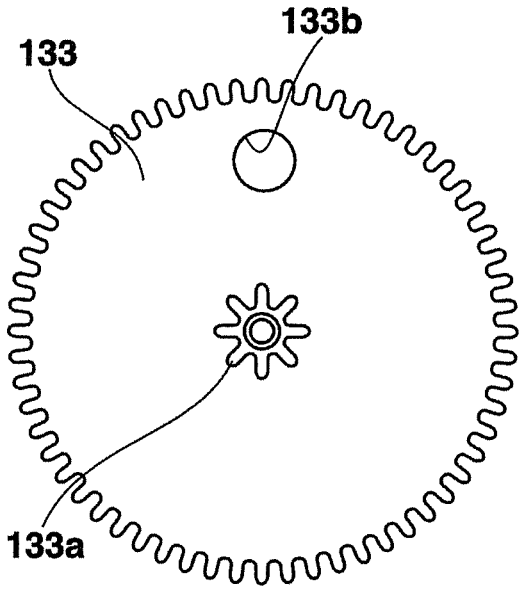
FIG. 10A is a plan view of the 1st intermediate wheel.
Figure 10B:
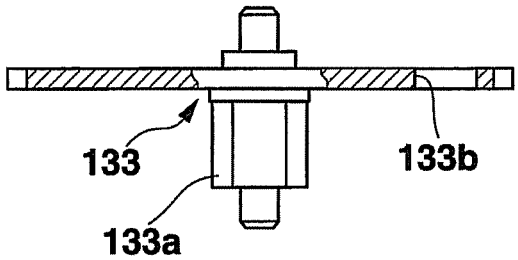
FIG. 10B is a sectional side view of the 1st intermediate wheel.

FIG. 10A is a plan view of the 1st intermediate wheel 133 of the embodiment, and FIG. 10B is a sectional side view of the 1st intermediate wheel 133. In the embodiment, as showed in FIGS. 10A and 10B, one 4th light transmission hole 133*b* as a detecting hole for detecting the hand position is provided in the 1st intermediate wheel 133.

As showed in FIGS. 6 and 7, the 1st light transmission hole 139*a* or 2nd light transmission hole 139*b* of the hand position detecting wheel 139, the 3rd light transmission hole 134*c* of the 2nd intermediate wheel 134, and the 4th light transmission hole 133*b* of the 1st intermediate wheel 133 overlap when the 1st intermediate wheel 133, 2nd intermediate wheel 134 or hand position detecting wheel 139 rotate to predetermined positions.

When a user input an instruction to detect the hand position by operating a not-shown operation button for example, the 1st intermediate wheel 133, the 2nd intermediate wheel 134, and the hand position detecting wheel 139 automatically rotate to the positions where the light transmission holes 133*b*, 134*c*, 139*a* or 139*b* overlap. When the wheels move to the positions where the light transmission holes 133*b*, 134*c*, 139*a* or 139*b* overlap, the light emitting element 31 of the hand position detecting mechanism 30 emits light and the light receiving element 32 receives this light to detect the hand position.

In addition, the timing to detect the hand position is not limited to this, and when the time to detect the hand position is set in advance for example, the wheels may automatically rotate and move to the positions where the light transmission holes 133*b*, 134*c*, 139*a* or 139*b* overlap upon this set time to detect the hand position.

Figure 11:
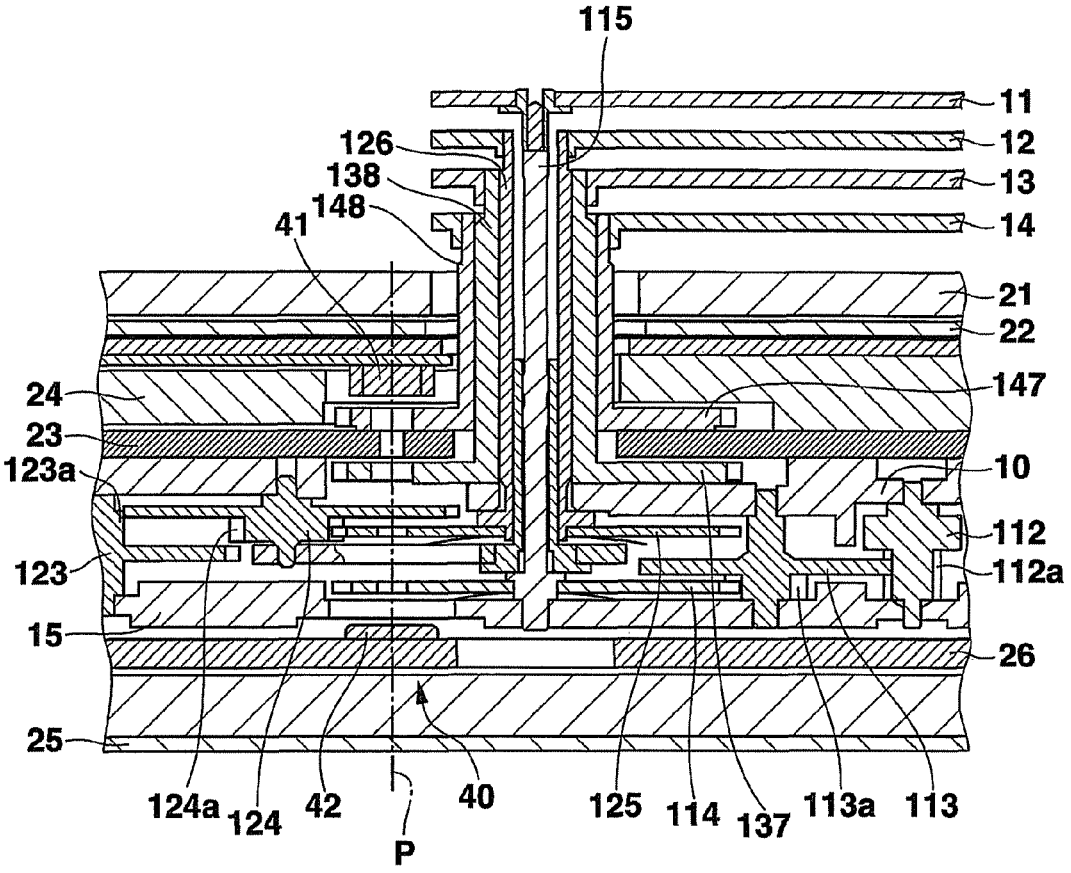
FIG. 11 is an enlarged view of a portion of a 2nd hand position detecting mechanism in FIG. 1.

Further, in the embodiment, as showed in FIGS. 1 and 2, the pointer indication type timepiece 100 has the 2nd hand position detecting mechanism 40 in the vicinity of the functional hand hour wheel 147 and the hour hand hour wheel 137 as the shaft members. FIG. 11 is a view enlarging the portion of the 2nd hand position detecting mechanism 40 in FIG. 1, and FIG. 12 is a view enlarging the portion of the 2nd hand position detecting mechanism 40 in FIG. 2.

Figure 12:
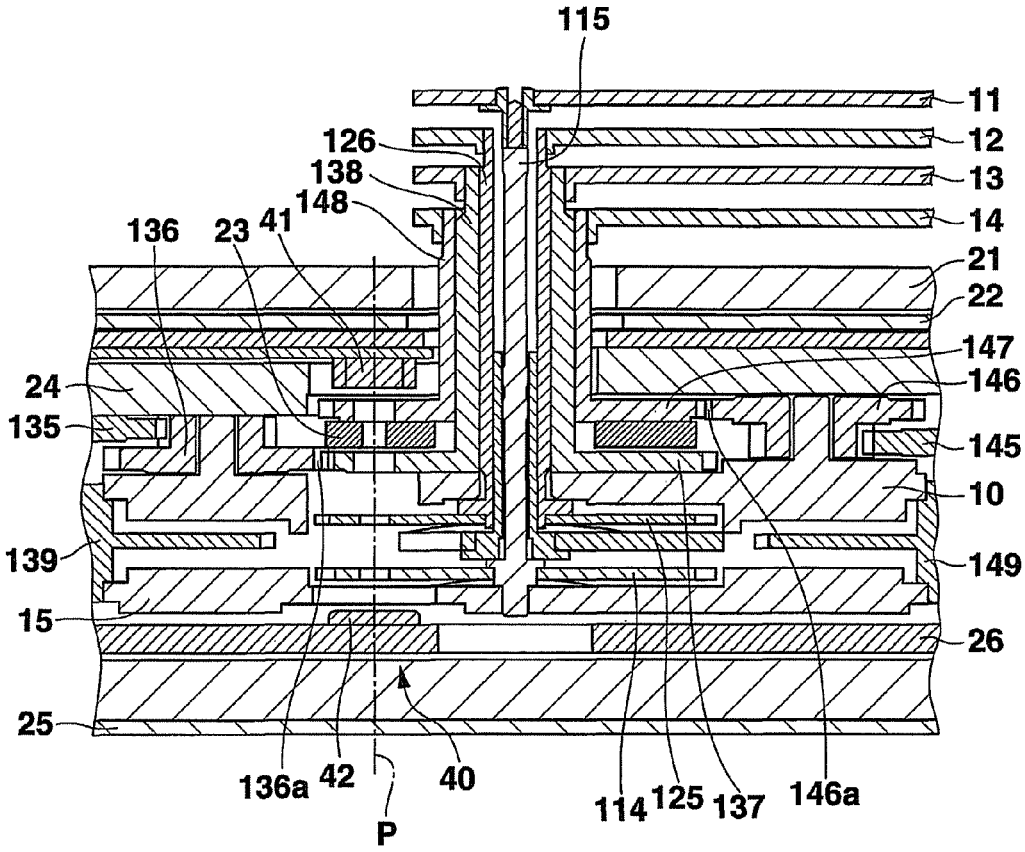
FIG. 12 is an enlarged view of a portion of a 2nd hand position detecting mechanism in FIG. 2.

As showed in FIGS. 11 and 12, similar to the 1st hand position detecting mechanisms 30 and 35, the 2nd hand position detecting mechanism 40 detects the hand position of the pointer indication type timepiece 100 by an optical method, and has a light emitting element 41 and a light emitting element 42. Similar to the light emitting element 31 of the 1st hand position detecting mechanism 30, the light emitting element 41 is formed with LED (Light Emitting Diode), and similar to the light receiving element 32, the light receiving element 42 is formed with a phototransistor.

The light receiving element 42 is provided at a position opposed to the light emitting element 41, and a detection position P is set on an optical axis connecting the light emitting element 41 and light receiving element 42.

The 5th wheel 113, 4th wheel 114, 2nd wheel 125, hour hand hour wheel 137, and functional hand hour wheel 147 are provided with the light transmission holes 113*a*, 114*a*, 125*a*, 137*a* and 147*a*, respectively, and when the 5th wheel 113, 4th wheel 114, 2nd wheel 125, hour hand hour wheel 137, and functional hand hour wheel 147 rotate to the predetermined positions and the light transmission holes 113*a*, 114*a*, 125*a*, 137*a* and 147*a* substantially overlap the detection position P, the light emitting element 41 emits light at the detection position P and the light receiving element 42 receives this light to detect the hand position.

Figure 13:
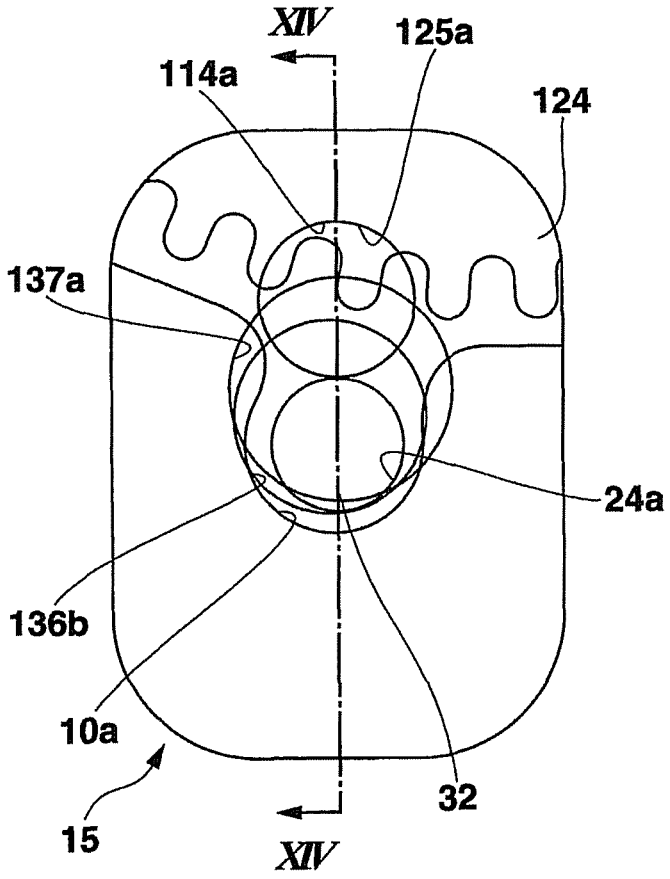
FIG. 13 is an enlarged view showing a detection position of the 2nd hand position detecting mechanism from a light emitting element side.
Figure 14:
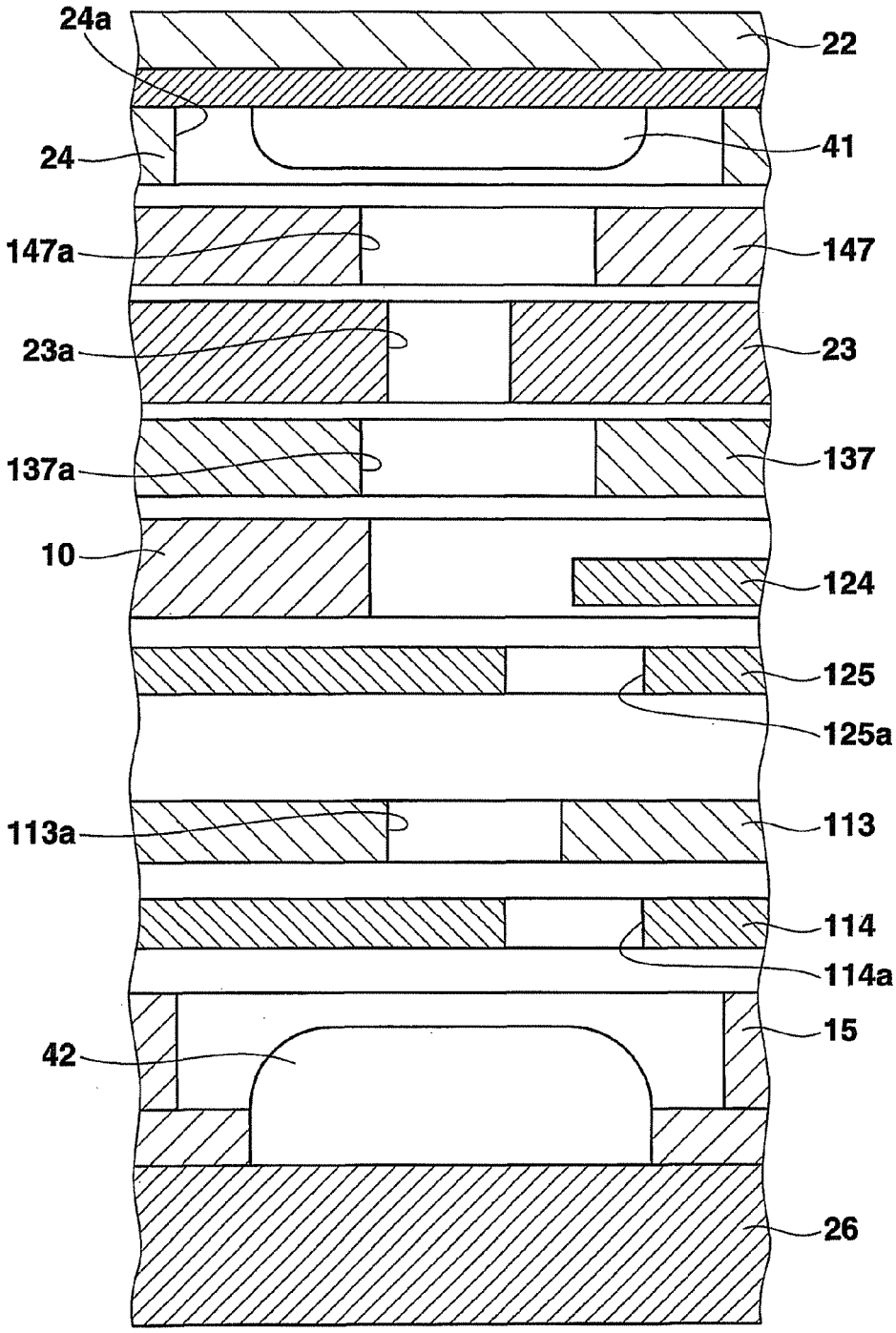
FIG. 14 is a sectional view of FIG. 13 in a direction of Arrow XIV-XIV.

As showed in FIGS. 13 and 14, the light transmission holes 113*a*, 114*a*, 125*a*, 137*a* and 147*a* provided in the 5th wheel 113, 4th wheel 114, 2nd wheel 125, hour hand hour wheel 137, and functional hand hour wheel 147 are misaligned more or less depending on a manufacturing precision of gears or the like, and therefore they are formed larger so that even if the light transmission holes 113*a*, 114*a*, 125*a*, 137*a* and 147*a* are misaligned more or less, light from the light emitting element 41 reaches the light receiving element 42. By this, when the misalignment is little and within the allowable range, the light receiving element 42 can receive light from the light emitting element 41, thereby enabling detection of the hand position.

As showed in FIG. 14, penetrating holes 24*a*, 23*a*, and 15*a* are formed at positions corresponding to the detection position P on the date indicator holding plate 24, magnetic shield plate 23, and gear train receiver plate 15 which are interposed between the light emitting element 41 and light receiving element 42, and do not block light from the light emitting element 41.

In the embodiment, the penetrating hole 23*a* provided in the magnetic shield plate 23 which also functions as a support plate receiving the functional hand hour wheel 147 functions as a focusing hole which focuses light from the light emitting element 41.

For example, while the diameters of the light transmission holes 113*a*, 114*a*, 125*a*, 137*a*, and 147*a* provided in the 5th wheel 113, 4th wheel 114 for example, 2nd wheel 125, hour hand hour wheel 137, and functional hand hour wheel 147 are between 0.3 mm and 0.4 mm, the diameter of the penetrating hole 23*a* provided in the magnetic shield plate 23 is about between 0.1 mm and 0.2 mm.

When the hand position is optically detected using the light emitting element 41 and light receiving element 42, there may be a situation where the light receiving element 42 receives light in a state where the light receiving element 42 must not receive light from the light emitting element 41 due to the influence of backlash of gears or the like.

In this regard, in the embodiment, since the penetrating hole 23*a* having a smaller diameter than the diameters of the light transmission holes 113*a*, 114*a*, 125*a*, 137*a* and 147*a* provided in the 5th wheel 113, 4th wheel 114, 2nd wheel 125, hour hand hour wheel 137, and functional hand hour wheel 147 is provided on the magnetic shield plate 23, it is possible to focus light from the light emitting element 41 and improve precision of light received by the light receiving element without providing additional members.

Next, the function of the embodiment will be described.

As described above, in the embodiment, the second hand 11, minute hand 12, hour hand 13, and functional hand 14 are each driven independently through each gear train mechanism by independent driving motors (1st motor 111, 2nd motor 121, 3rd motor 131 and 4th motor 141).

More specifically, when the 1st motor 111 rotates, this rotation movement is transmitted from the gear member 112*a* of the rotor 112 of the 1st motor 111 to the 5th wheel 113, and is transmitted from the 5th wheel 113 to the 4th wheel 114. By this, the 4th wheel 114 rotates about the second hand shaft 115, and second hand 11 rotates above the dial 21.

Similarly, when the 2nd motor 121 rotates, this rotation movement is transmitted from the gear member 122*a* of the rotor 122 of the 2nd motor 121 to the intermediate wheel 123, is transmitted from the intermediate wheel 123 to the 3rd wheel 124 and is further transmitted from the 3rd wheel 124 to the 2nd wheel 125. By this, the 2nd wheel 125 rotates about the minute hand shaft 126, and the minute shaft 12 is driven to rotate above the dial 21.

Further, when the 3rd motor 131 rotates, this rotation movement is transmitted from the gear member 132*a* of the rotor 132 provided in the 3rd motor 131 to the 1st intermediate wheel 133, is transmitted from the 1st intermediate wheel 133 to the 2nd intermediate wheel 134, and is transmitted from the 2nd intermediate wheel 134 to the 3rd intermediate wheel 135, from the 3rd intermediate wheel 135 to the 4th intermediate wheel 136, and from the 4th intermediate wheel 136 to the hour hand hour wheel 137. By this, the hour hand hour wheel 137 rotates about the cylindrical member 138, and the hour hand 13 is driven to rotate above the dial 21.

At this time, the 1st intermediate wheel 133 meshes with the 2nd intermediate wheel 134 in the 1st space R1 on the rear side of the gear support plate 10 to transmit rotation movement to the 2nd intermediate wheel 134, and the 3rd intermediate wheel 135 meshes with the 2nd small gear 134*b* in the 2nd space R2 on the front side of the gear support plate 10 to receive rotation movement transmitted from the 2nd intermediate wheel 134. By this, the hour hand gear train mechanism shifts from the rear side to the front side of the gear support plate 10 at the 2nd intermediate wheel 134 as the boundary.

Further, the 1st small gear 134*a* of the 2nd intermediate wheel 134 provided on the rear side of the gear support plate 10 is meshed with the hand position detecting wheel 139, and the hand position detecting wheel 139 rotates with a rotation of the 2nd intermediate wheel 134. When the user instructs to detect the hand position or the already-set time as the time to detect the hand position comes, the 1st intermediate wheel 133, 2nd intermediate wheel 134, and hand position detecting wheel 139 rotate and move to the predetermined positions, and the light emitting element 31 of the 1st hand position detecting mechanism 30 emits light and the light receiving element 32 detects this light to detect the hand position of the hour hand 13.

Similarly, when the 4th motor 141 rotates, this rotation movement is transmitted from the gear member 142*a* of the rotor 142 provided in the 4th motor 141 to the 1st intermediate wheel 143, is transmitted from the 1st intermediate motor 143 to the 2nd intermediate wheel 144, and is transmitted from the 2nd intermediate wheel 144 to the 3rd intermediate wheel 145, from the 3rd intermediate wheel 145 to the 4th intermediate wheel 146, and from the 4th intermediate wheel 146 to the functional hand hour wheel 147. By this, the functional hand hour wheel 147 rotates about the cylindrical member 148, and the functional hand 14 is driven to rotate above the dial 21.

At this time, the 1st intermediate wheel 143 meshes with the 2nd intermediate wheel 144 in the 1st space R1 on the rear side of the gear support plate 10 to transmit a rotation movement to the 2nd intermediate wheel 144, the 3rd intermediate wheel 145 meshes with the 2nd small gear in the 2nd space R2 on the front side of the gear support plate 10 to receive a rotation movement transmitted from the 2nd intermediate wheel 144. By this, the functional hand gear train mechanism shifts from the rear side to the front side of the gear support plate 10 at the 2nd intermediate wheel 144 as the boundary.

Further, the 1st small gear of the 2nd intermediate wheel 144 provided on the rear side of the gear support plate 10 is meshed with the hand position detecting wheel 149, and the hand position detecting wheel 149 rotates with a rotation of the 2nd intermediate wheel 144. When the user instructs to detect the hand position or the already-set time as the time to detect the hand position comes, the 1st intermediate wheel 143, 2nd intermediate wheel 144, and hand position detecting wheel 149 rotate and move to the predetermined positions, and the light emitting element 36 of the 1st hand position detecting mechanism 35 emits light and the light receiving element 37 detects this light to detect the hand position of the functional hand 14.

Further, the pointer indication type timepiece 100 detects and corrects the hand positions of the second hand 11 and the minute hand 12 by the 2nd hand position detecting mechanism 40.

More specifically, the hand positions of the second hand 11 and the minute hand 12 are detected when the 5th wheel 113, 4th wheel 114, 2nd wheel 125, hour hand hour wheel 137, and functional hand hour hand 147 move to the predetermined detection position P where the position where the light transmission holes 113*a*, 114*a*, 125*a*, 137*a* and 147*a* overlap, the light emitting element 41 emits light, and light receiving element 42 detects this light.

At this time, since the penetrating hole 23*a* provided in the magnetic shield plate 23 which supports the functional hand hour wheel 147 focuses light from the light emitting element 41, it is possible to block light coming around from the periphery and precisely detect light in the light receiving element 42. Since at least the gear positioned immediately close to the 1st hand among the hands to which the rotation movements of the driving motors are transmitted by the different gear train mechanisms is arranged on the front side of the support plate, and since the gear positioned immediately close to the 2nd hand is arranged on the rear side of the support plate, the gears are provided in a distributed arrangement near the center of the multi-hand electronic device without being concentrated on a single surface of the support plate.

As described above, according to the present embodiment, the hour hand hour wheel 137 positioned immediately close to the hour hand 13 to which the rotation movement of the 3rd motor 131 is transmitted by the hour hand gear train mechanism and the functional hand hour wheel 147 positioned immediately close to the functional hand 14 to which the rotation movement of the 4th motor 141 is transmitted by the functional hand gear train mechanism are arranged on the front side of the gear support substrate 10, and the gear (the 4th wheel 114 positioned immediately close to the second hand 11, for example) which constitutes the second hand gear train mechanism and the gear (the 2nd wheel 125 positioned immediately close to the minute hand 12, for example) which constitutes the minute hand gear train mechanism are arranged on the rear side of the gear support plate 10.

Consequently, it becomes possible to efficiently assemble the gears without being concentrated to one side of the gear support plate 10 in the vicinity of the center of the hand-type clock 100.

The embodiment provides, on the front and rear sides of the 2nd intermediate wheels 134, 144, the 1st small gears 134*a*, 144*a* positioned on the rear side of the gear support plate 10 and the 2nd small gears 134*b*, 144*b* positioned on the front side of the gear support plate 10, receives the rotation movements of the 3rd driving motor 131 for rotating the hour hand 13 and the 4th driving motor 141 for rotating the functional hand 14 by the 1st small gears 134*a*, 144*a* positioned on the rear side of the gear support plate 10, and then transmits the rotation movements to the 4th intermediate wheels 135, 145 which mesh with the 2nd small gear 134*b*, 144*b* positioned on the front side of the gear support plate 10.

By this, the hour hand gear train mechanism which transmits the rotation movement of the 3rd driving motor 131 to each hour hand 13 and the functional hand gear train mechanism which transmits the rotation movement of the 4th driving motor 141 to the functional hand 14 can shift from the rear side to the front side of the gear support plate 10 along the way. Consequently, the gears can be efficiently set inside the pointer indication type timepiece 100, and the pointer indication type timepiece 100 can be miniaturized and made thin as a whole.

Further, since three sets of the hand position detecting mechanisms are provided in the embodiment, it is possible to more precisely detect the hand position and correct the hand position.

In other words, particularly, when four hands of the second hand 11, minute hand 12, hour hand 13, and functional hand 14 are independently driven by respectively different driving motors (1st to 4th motors 111, 121, 131 and 141) as described in the present embodiment, the minute hand 12, hour hand 13, and functional hand 14 also moves in fine steps, and therefore it is difficult to precisely and completely correct all hands only with one conventional hand position detecting mechanism formed with a set of a light emitting element (LED) and light receiving element (phototransistor).

In this regard, in the embodiment, the hand positions of two hands of the second hand 11 and minute hand 12 are detected by the light emitting element 41 (LED) and light receiving element 42 (phototransistor) of the 2nd hand position detecting mechanism 40 in the vicinity of the center of the timepiece movement 1 similar to the conventional manner, and the hand positions of the hour hand 13 and functional hand 14 are detected by three sets of the hand position detecting mechanisms 30, 35 and 40 in total by providing the 1st hand position detecting mechanisms 30 and 35 formed with the light emitting elements 31 and 36 (LEDs) and light receiving elements 32 and 37 (phototransistors) separately from the 2nd hand position detecting mechanism 40. Consequently, it is possible to accurately detect the hand position and completely correct the hand position.

Further, light transmission holes used for detection in the 1st hand position detecting mechanisms 30 and 35 are provided in the 2nd intermediate hand 134 which functions to shift the gear train mechanisms from the rear side to the front side of the gear support plate 10 along the way as described above to use for detection of the hand position. Consequently, even when three sets of hand position detecting mechanisms are provided, members additionally having light transmission holes need not to be provided and hand positions can be precisely detected with less space.

Further, in the embodiment, a four hand coaxial independent driving configuration of coaxially and independently driving the hands of the second hand 11, minute hand 12, hour hand 13, and functional hand 14 by the respectively different driving motors (1st to 4th motors 111, 121, 131 and 141), so that, even when a plurality of hands are provided, it is possible to precisely control each hand and support higher functions of implementing a plurality of functions in a multi-hand electronic device.

Figure 15:
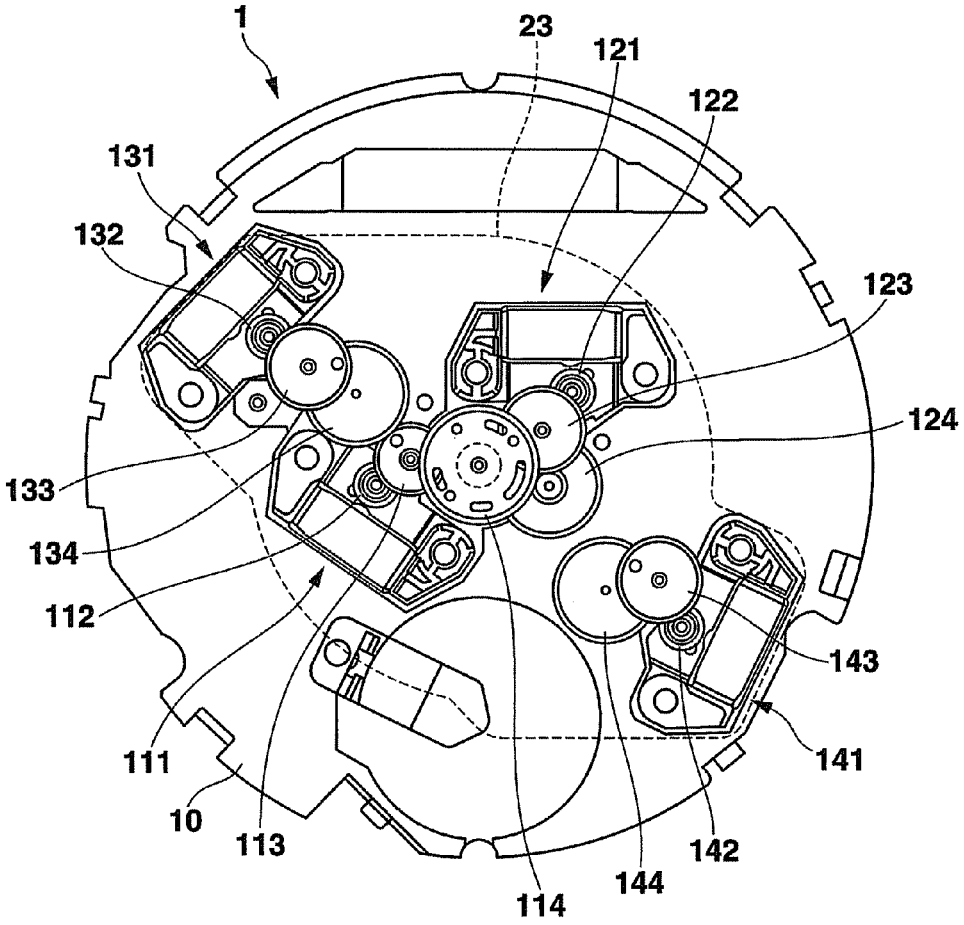
FIG. 15 is a plan view showing a timepiece movement according to a modification of the embodiment viewed from a rear surface side thereof.

In addition, although a case has been described with the embodiment where the 1st hand position detecting mechanisms 30 and 35 and 2nd hand position detecting mechanism 40 are both used to detect the hand position, the 1st hand position detecting mechanisms 30 and 35 may not be necessarily provided and only the 2nd hand position detecting mechanism 40 may be configured to detect the hand position. In this case, as showed in FIG. 15, a configuration is possible without the hand position detecting wheel.

Further, although a case has been described with the present embodiment where one magnetic shield plate 23 having a shape covering all of four driving motors (1st motor 111, 2nd motor 121, 3rd motor 131 and 4th motor 141) is provided on the dial 21 side, the shape of the magnetic shield plate 23, the position to arrange the magnetic shield plate 23 and the number of the magnetic shield plates 23 are not limited in particular. For example, magnetic shield plates may be arranged not only on the dial plate 21 side (upside in FIG. 1), but also on the circuit substrate 26 side (downside in FIG. 1).

Figure 16:
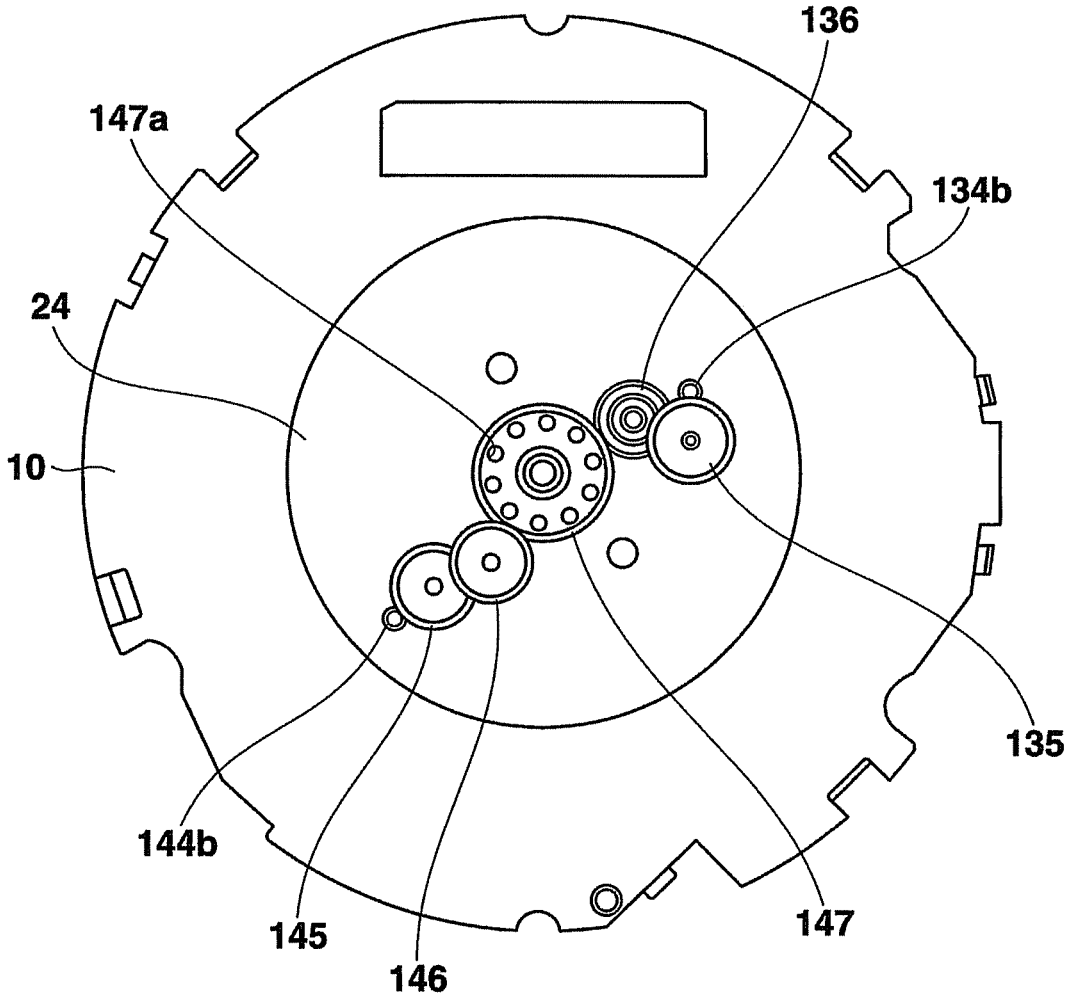
FIG. 16 is a plan view showing a timepiece movement according to a modification of the embodiment viewed from a front surface side thereof.
Figure 17:
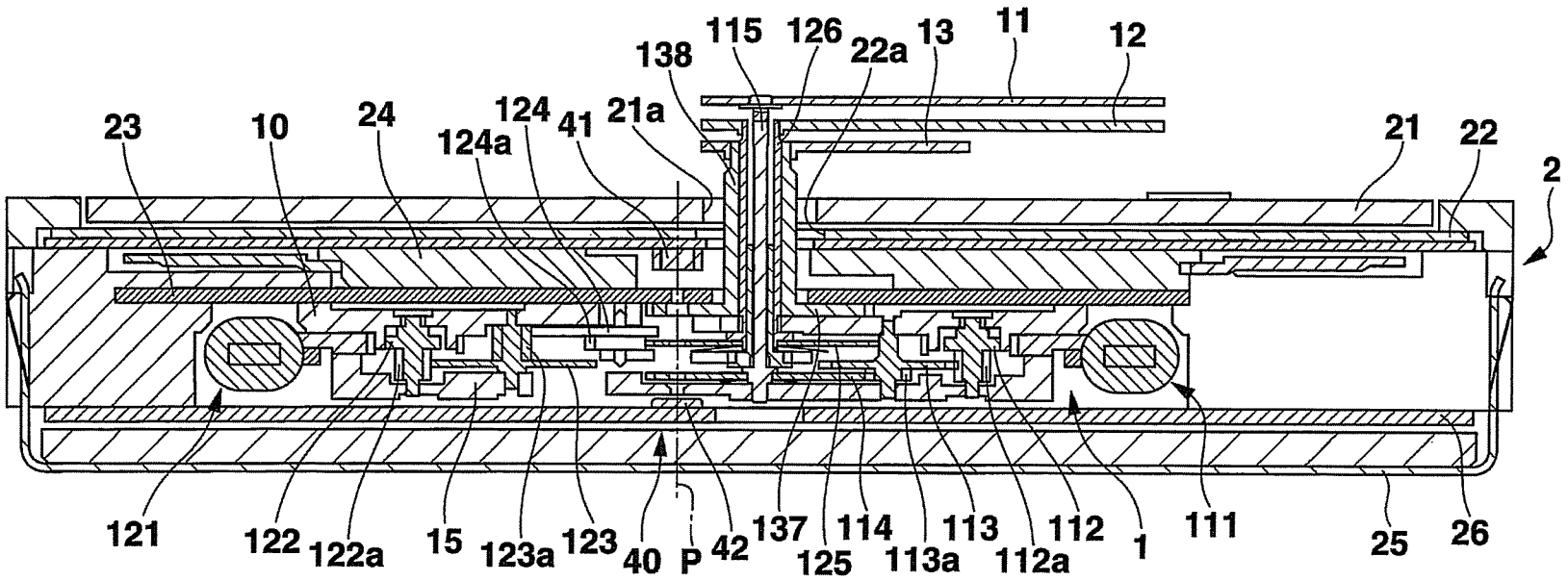
FIG. 17 is a main-part sectional view showing a schematic configuration of a second hand gear train mechanism and a minute hand gear train of a pointer indication type timepiece according to a modification of the embodiment.

Further, if the case of the timepiece is made of material which blocks the magnetic field from coming inside from the outside, a configuration without a magnetic shield plate is possible as showed in FIG. 16.

Further, although an example of four hand independent driving of independently driving four hands of the second hand 11, minute hand 12, hour hand 13 and functional hand 14 by means of respectively different driving motors (1st to 4th motors 111, 121, 131 and 141), the number of hands to independently drive is not limited to this, and a configuration further having a plurality of functional hands is possible for example.

In this case, a configuration is preferable where with respect to a substantially half of the gear train mechanisms, at least gears near the hands are arranged on the front side of the gear support plate 10, and with respect to the other half, at least gears near the hands are arranged on the rear side of the gear support plate 10, such that the gears are not concentrated on one of the front and rear sides of the gear support plate 10 in the vicinity of the center of the timepiece movement 1.

When the number of hands is increased, it is preferable to maintain precision to detect the hand position of each hand by increasing the number of hand position detecting mechanisms.

Although an example has been described with the embodiment where all hands are independently driven, part of the hands may be configured to be driven by the same driving motor.

As showed in FIGS. 17 to 20, the present invention is applicable even in cases where three hand independent driving is adopted for independently driving three hands of the second hand 11, the minute hand 12, and the hour hand 13 by the respectively different driving motors (1st to 3rd motors 111, 121 and 131). In addition, the magnetic shield plate 23 is not showed in FIGS. 19 and 20.

In this case, for example as showed in FIG. 2, a configuration is employed where the 1st small gears 134*a* and 2nd small gears 134*b* are provided on the front and rear sides of the 2nd intermediate wheel 134 of the hour hand gear train mechanism which drives the hour hand 13, a rotation movement of the 3rd motor 131 received on the rear side of the gear support plate 10 is transmitted to the 3rd intermediate wheel 135 on the front side of the gear support plate 10, and the hour hand gear train mechanism shifts from the rear side to the front side of the gear support plate 10 at the 2nd intermediate wheel 134 as the boundary.

As described above, according to the embodiment, there is provided a multi-hand electronic device (multi-hand electronic device in FIGS. 1, 2 etc.) including: a plurality of hands (second hand 11, minute hand 12, hour hand 13, and functional hand 14 in FIGS. 1, 2 etc.); one or a plurality of driving motors (1st to 4th motors 111, 121, 131, 141 in FIGS. 1, 2 etc.) for making the hands rotate; a gear train mechanism which includes a plurality of gears (forth wheel 114, 2nd wheel 125, 1st intermediate wheel 133, 2nd intermediate wheel 134, hour hand hour wheel 137, and functional hand hour wheel 147 in FIGS. 1, 2 etc.) for transmitting a rotation movement of the driving motors to the hands; and a support plate (gear support plate 10 in FIG. 2 etc.) which supports the gears, wherein the hands include a 1st hand (hour hand 13, functional hand 14 in FIG. 2 etc.) and a 2nd hand (second hand 11, minute hand 12 in FIG. 1 etc.) to which the rotation movement of the driving motors is transmitted via the gear train mechanism, and a gear (hour hand hour wheel 137, functional hand hour wheel 147 in FIGS. 1, 2 etc.) positioned close to the 1st hand among the gears is arranged on a front side of the support plate, and a gear (forth wheel 114, 2nd wheel 125 in FIG. 1 etc.) positioned close to the 2nd hand among the gears is arranged on a rear side of the support plate.

Moreover, in the multi-hand electronic device (multi-hand electronic device in FIGS. 1, 2 etc.), the 1st hand (13, 14) includes an hour hand (hour hand 13), and the 2nd hand (11, 12) includes a minute hand (minute hand 12) and a second hand (second hand 11), and a gear (hour hand hour wheel 137 in FIG. 2 etc.) positioned close to the hour hand (hour hand 13 in FIG. 2 etc.) among the gears is arranged on the front side of the support plate (gear support plate 10 in FIG. 2 etc.), and a gear (4th wheel 114, 2nd wheel 125 in FIG. 1 etc.) positioned close to the minute hand (12) and the second hand (11) is arranged on the rear side of the support plate.

Furthermore, in the multi-hand electronic device (multi-hand electronic device in FIGS. 1, 2 etc.), the hands (second hand 11, minute hand 12, hour hand 13, and functional hand 14 in FIGS. 1, 2 etc.) are independently driven by respectively different driving motors.

Figure 18:
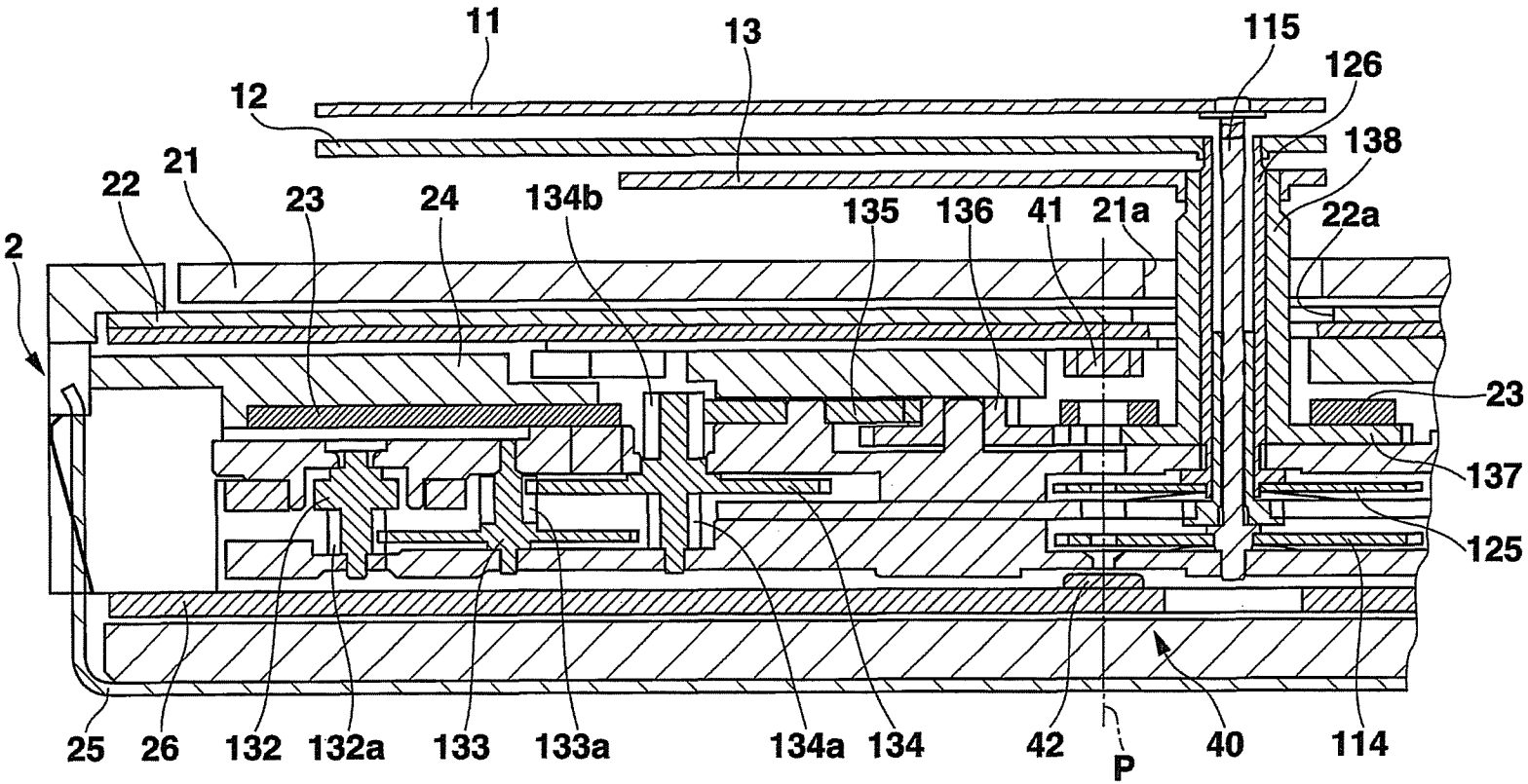
FIG. 18 is a main-part sectional view showing a schematic configuration of an hour hand gear train mechanism and a functional hand gear train of a pointer indication type timepiece according to a modification of the embodiment.
Figure 19:
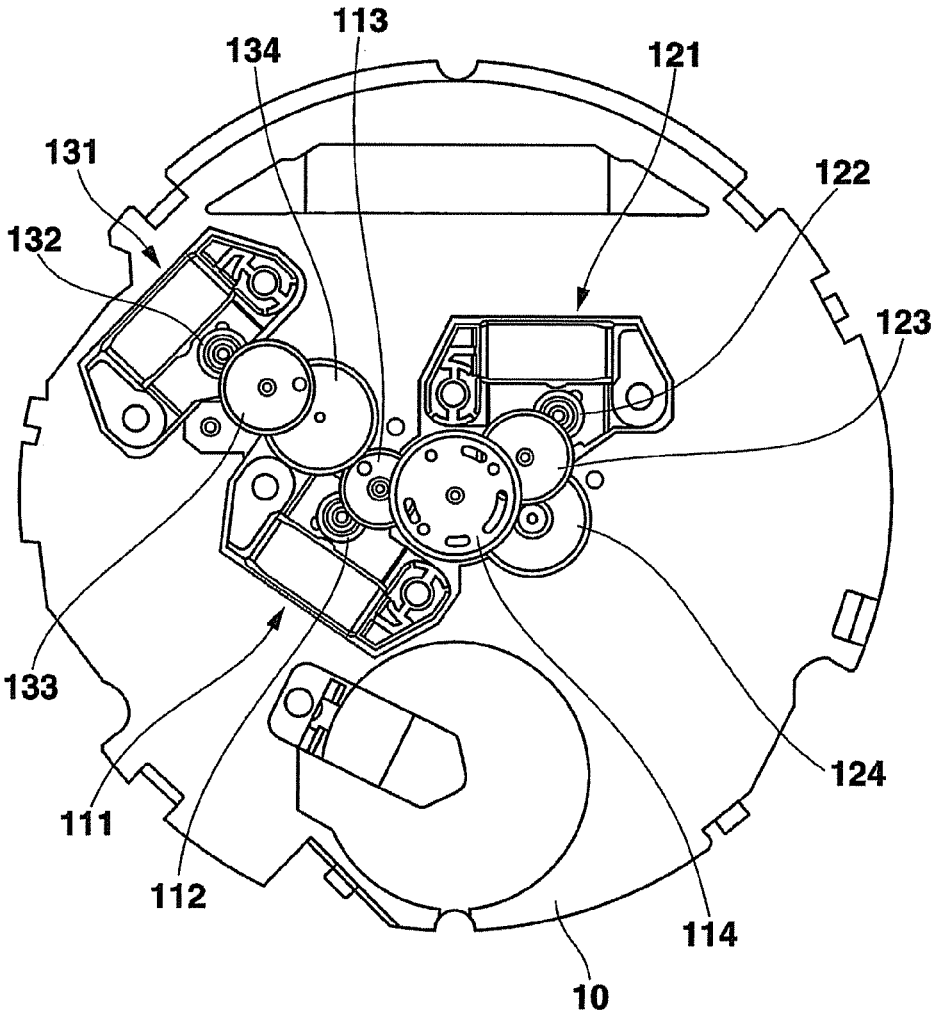
FIG. 19 is a plan view showing a timepiece movement of a pointer indication type timepiece showed in FIG. 17 viewed from a rear surface side thereof.
Figure 20:
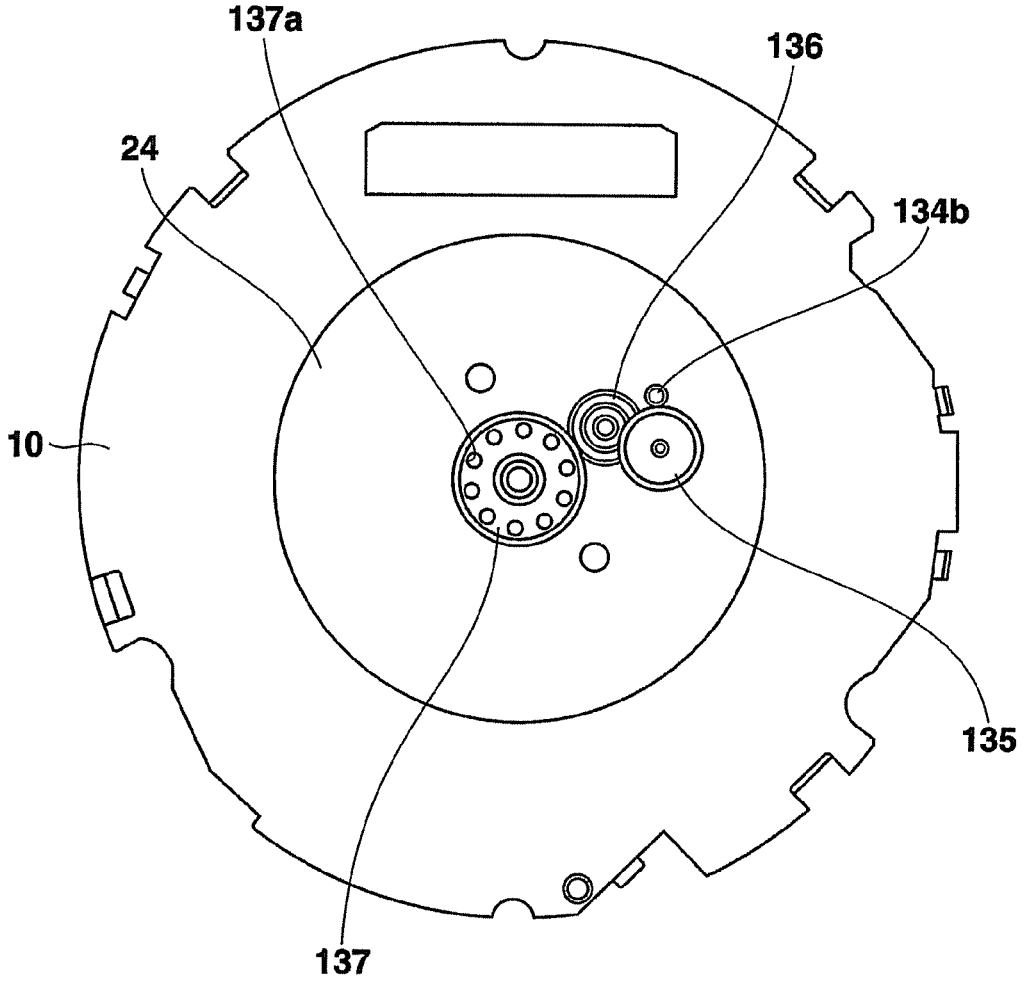
FIG. 20 is a plan view showing a timepiece movement of a pointer indication type timepiece showed in FIG. 17 viewed from a front surface side thereof.

In addition, although not showed in FIGS. 18 and 19, a hand position detecting wheel may be provided in the position meshing with the 1st small gear 134*a* and a 1st hand position detecting mechanism which detects the hand position of the hour hand may be provided.

An arrangement and the number of gears forming each gear train mechanism are not limited to the arrangement and the number described in the embodiment.

For example, the number of intermediate wheels forming the hour hand gear train mechanism is not limited to four, and may be more and may form the hour gear train mechanism with three or less gears.

Although a configuration is employed with the embodiment where small gears are provided on the front and rear sides of the 2nd intermediate wheels 134 and 144 forming the hour hand gear train mechanism and functional hand gear train mechanism and these 2nd intermediate wheels 134 and 144 are functions as the 1st gears, the small gears may be provided on the front and rear sides of the gears other than the 2nd intermediate wheels 134 and 144 and these gears may be functioned as the 1st gears.

Moreover, although a configuration is employed with the embodiment where the magnetic shield plate 23 also functions as the support plate which receives the functional hand hour wheel 147, the magnetic shield plate 23 may also function as the support plate which receives other gears such as the hour hand hour wheel 137.

Furthermore, although a case has been described with the embodiment as an example where a multi-hand electronic device is a pointer indication type timepiece having a plurality of hands, the present invention is generally applicable as long as an electronic device has a plurality of hands and moves hand by transmitting power to hands through gears, and is not limited to the pointer indication type timepiece. The present invention is applicable even to multi-hand electronic devices for various indicators. The word "timepiece device" also includes a general electronic device with multiple-hand, such as one or more of an hour hand, a minute hand, a second hand, and/or a functional hand.

In addition, it naturally follows that the present invention is not limited to the above embodiment and can be adequately changed.

What is claimed is:

1. A timepiece device with multiple-hand comprising:

a plurality of hands;

a plurality of driving motors each of which individually drives each of the hands so that the hands rotate;

one or more gear train mechanisms each of which includes a plurality of gears for transmitting a rotation movement of each of the driving motors to each of the hands; and a support plate which supports the gears;

wherein the hands include a first hand and a second hand provided above a first side of the support plate, to which hands the rotation movements of first and second driving motors among the driving motors are transmitted via first and second gear train mechanisms among the gear train mechanisms, respectively;

wherein the driving motors are provided on a second side of the support plate, wherein among the gears of the first gear train mechanism which transmits the rotation movement of the first driving motor to the first hand, a gear which is positioned close to the first hand is arranged above the first side of the support plate, wherein among the gears of the first gear train mechanism which transmits the rotation movement of the first driving motor to the first hand, one gear has first and second gear members provided on two sides of the one gear respectively, the gear members meshing with gears which are different from each other above the first side of the support plate and below the second side of the support plate respectively, wherein the gears of the second gear train mechanism, which transmits the rotation movement of the second driving motor to the second hand, are arranged below the second side of the support plate, and wherein the first driving motor which drives the first hand, and the one gear which has the first and second gear members provided on the two sides respectively, are located outward with respect to a rotation axis of the hands, more than the second gear train mechanism which drives the second hand and is arranged below the second side of the support plate.

2. The timepiece device with multiple-hand according to claim 1, wherein the first hand includes an hour hand, and the second hand includes a minute hand and/or a second hand.

* * * * *